US011885507B2

(12) United States Patent
Tilley et al.

(10) Patent No.: US 11,885,507 B2
(45) Date of Patent: Jan. 30, 2024

(54) INSTANTANEOUS HOT WATER HEAT PUMP

(71) Applicants: Timothy Tilley, Georgetown, SC (US); Edward John Jersek, Pawleys Island, SC (US); John David Schroer, Pawleys Island, SC (US)

(72) Inventors: Timothy Tilley, Georgetown, SC (US); Edward John Jersek, Pawleys Island, SC (US); John David Schroer, Pawleys Island, SC (US)

( * ) Notice: Subject to any disclaimer, the term of this patent is extended or adjusted under 35 U.S.C. 154(b) by 118 days.

(21) Appl. No.: 17/328,209

(22) Filed: May 24, 2021

(65) Prior Publication Data

US 2022/0373193 A1 Nov. 24, 2022

(51) Int. Cl.

| | |
|---|---|
| ***F24D 17/02*** | (2006.01) |
| ***F24D 19/10*** | (2006.01) |
| *F24H 4/04* | (2006.01) |

(52) U.S. Cl.

CPC ..... *F24D 17/02* (2013.01); *F24D 19/1054* (2013.01); *F24H 4/04* (2013.01)

(58) Field of Classification Search

USPC ..... 237/2 B

See application file for complete search history.

(56) References Cited

U.S. PATENT DOCUMENTS

| | | | | |
|---|---|---|---|---|
| 7,575,001 | B2 | 8/2009 | Kaiser | |
| 10,571,135 | B2 | 2/2020 | Kreutzman | |
| 2011/0289952 | A1* | 12/2011 | Kim | F24H 9/0005 62/189 |
| 2012/0312042 | A1* | 12/2012 | Jeong | F25B 25/005 62/238.7 |
| 2015/0059379 | A1* | 3/2015 | Ootani | F24D 17/02 62/190 |
| 2015/0159960 | A1* | 6/2015 | Fujitsuka | F24D 17/02 165/10 |
| 2021/0302084 | A1* | 9/2021 | Suemitsu | F25B 1/053 |

FOREIGN PATENT DOCUMENTS

| | | |
|---|---|---|
| CN | 101627264 | 1/2010 |
| JP | 2005083585 | 3/2005 |
| JP | 2005140439 | 6/2005 |
| JP | 3811682 | 8/2006 |
| JP | 4114930 | 7/2008 |
| JP | 4778299 | 9/2011 |
| JP | 4839141 | 12/2011 |
| JP | 4971838 | 7/2012 |
| JP | 5173780 | 4/2013 |
| JP | 5215692 | 6/2013 |
| JP | 5494703 | 5/2014 |
| JP | 5884042 | 3/2016 |
| KR | 101436241 | 8/2014 |

* cited by examiner

*Primary Examiner* — Steven B McAllister
*Assistant Examiner* — John E Bargero
(74) *Attorney, Agent, or Firm* — B. Craig Killough

(57) ABSTRACT

Non-potable, utility water is circulated by a pump in a closed loop. The utility water is heated by a heat pump. Heat exchange from the utility water heats domestic hot water on demand, eliminating or reducing the need for domestic hot water storage tanks and storage of large quantities of water. In the present invention, fluctuations in condenser water temperature are dampened internally in a condenser water buffer and a control system.

16 Claims, 2 Drawing Sheets

INSTANTANEOUS HOT WATER HEAT PUMP

BACKGROUND OF THE INVENTION

The use of electric powered heat pumps to heat domestic water is particularly useful where fossil fuels are either not available or are restricted to meet air pollution standards and/or to meet global warming prevention objectives for heating uses. Furthermore, heating water with a heat pump has a high efficiency compared to electric resistance heating. It is conceivable that heat pump water heating will consume 25% of the electric power of electric resistance heating for the same load.

Conventional heat pump water heaters produce domestic hot water directly from the condenser. From there, water flows into a series of domestic hot water storage tanks. A large volume of water and domestic hot water storage is required due to short cycling of the heat pump compressors. There is a need for a heat pump water heater that negates the need for domestic hot water storage and will provide instantaneous domestic hot water on demand. Domestic hot water storage may be employed, but a large water storage facility is not required.

A typical domestic water heat pump heats the domestic water directly within the condenser of the heat pump. These systems are dead band controlled and the temperature of the heated domestic water fluctuates significantly. The fluctuations in temperature are dampened by insertion of one or more storage tanks in the domestic hot water system downstream of the heat pump.

SUMMARY OF THE INVENTION

Non-potable, utility water is circulated by a pump in a closed loop. The utility water is heated by a heat pump. Heat exchange from the utility water heats domestic hot water on demand, eliminating or reducing the need for domestic hot water storage tanks and storage of large quantities of domestic hot water. In the present invention, fluctuations in condenser water temperature are dampened internally in a condenser water buffer and a control system as described herein.

BRIEF DRAWING DESCRIPTION

DESCRIPTION OF PREFERRED EMBODIMENTS

Figure 1:
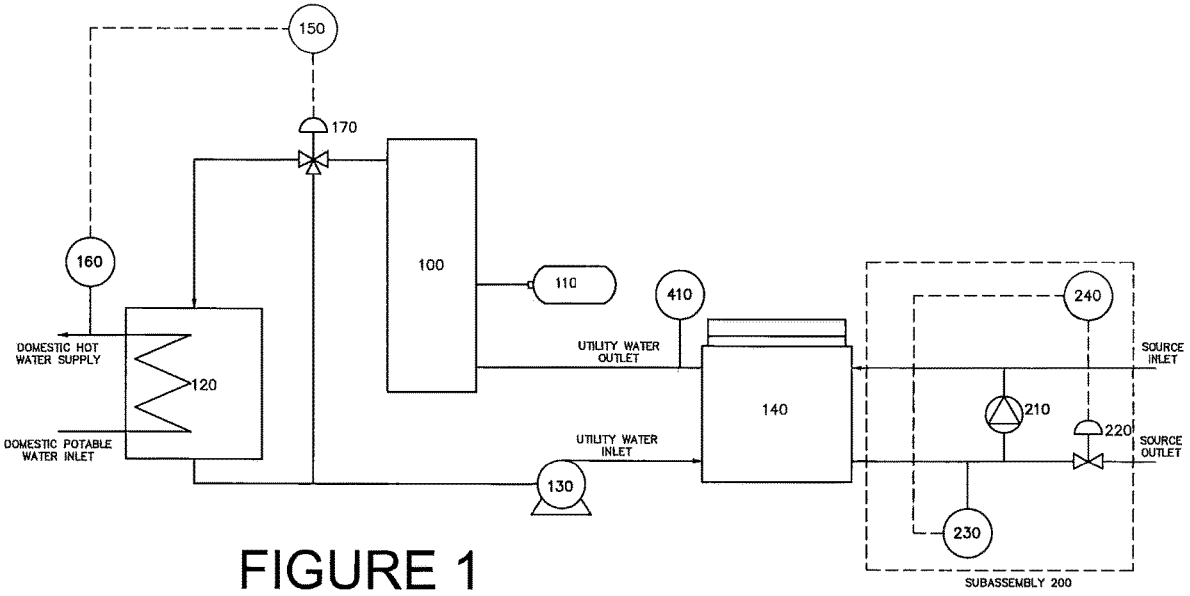
FIG. 1 is a schematic of an embodiment of an instantaneous domestic hot water heat pump according to the invention.

FIG. 1 demonstrates an instantaneous domestic hot water heat pump that is useful for multi-family residential and/or commercial applications. FIG. 1 shows: buffer 100, expansion tank 110, double-walled heat exchanger 120, circulating pump 130, water-to-water heat pump 140, temperature control valve 170, temperature sensor 160, and temperature controller 150.

As shown in the drawing figures, an embodiment of the device utilizes three loops in which water is circulated. The first loop is source water supplied to the evaporator 340 of the water-to-water heat pump 140, FIG. 2. The water may be supplied from the building water cooling system, or other source, at the source inlet. Source water external to the water-to-water heat pump circulation system enters from the building cooling system, or other source, at the source inlet as shown to provide water to the water-to-water heat pump 140. In some embodiments, external water may be provided to the water-to-water heat pump circulation system from another source.

Non-potable, utility water is circulated by water pump 130 in a second loop, or condenser water system, which is a closed loop. FIG. 1. The utility water is heated by the heat pump. Utility water travels through water-to-water heat pump 140, to condenser water buffer 100 and then to double-walled heat exchanger 120. The utility water returns to the water-to-water heat pump 140 after exiting the double-walled heat exchanger 120.

In the third loop, domestic potable water external to the heat pump circulation system enters from the building domestic water supply at the domestic potable water inlet and absorbs heat from the double-walled heat exchanger 120 in the embodiment shown. Domestic hot water, heated in the double-walled heat exchanger 120, is instantaneously available for use.

Figure 2:
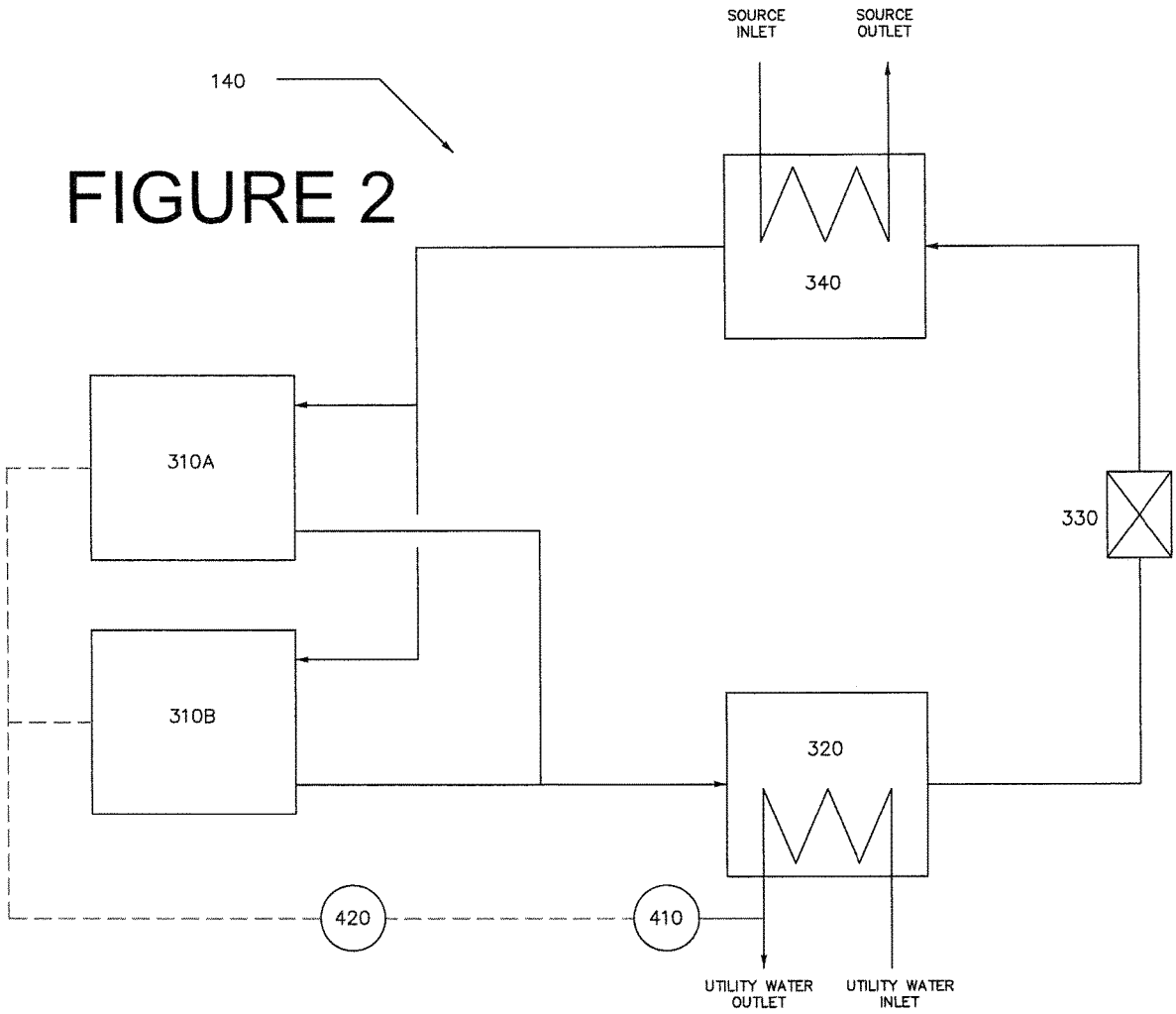
FIG. 2 shows a schematic of an embodiment of a heat pump that may be used with the invention.

Water-to-water heat pump 140 is an electric powered refrigerant heat pump in the embodiment as shown. The refrigerant used in the heat pump can be R134a, R410a, R514, R1233zd, carbon dioxide, or other (preferably, non-ozone depleting, low global warming potential) refrigerant. As shown in FIG. 2, the refrigerant circulates through the water-to-water heat pump 140 internally and in a closed loop. The refrigerant is compressed in one or more compressors 310A/310B, condensed in an internal heat exchanger 320 (condenser) where heat is removed, the refrigerant is expanded through an expansion valve 330, and evaporates in a separate internal heat exchanger 340 (evaporator) where heat is absorbed into the refrigerant. A preferred heat pump operates in a Reverse Carnot Cycle, and provides two (2) heat exchangers, an evaporator and a condenser.

As shown in FIG. 2, this invention embodies a condenser outlet temperature sensor 410, interconnected to controller 420. Controller 420 utilizes algorithms for unique staging and control of the compressors 310A/310B. Additional compressors may be provided in some embodiments. which may be variable frequency controlled, or controlled by a discrete signal. Dead band range control of compressors 310A/310B, controlled by controller 420 algorithms, provide operation and staging of the compressors 310A/310B, preventing short cycling, thereby prolonging seamless operation of the compressors. Controller 420 monitors and controls the heat pump compressors (310A/310B) via a serial control network. Each compressor is staged On/Off, or speed controlled by variable frequency drives, using individual temperature setpoints that limit the rate of temperature increase/decrease. Controller 420 algorithms prevent compressor short cycling, which frequently occurs with conventional heat pump controllers. The outlet temperature sensor 410 provides water temperature measurement and compares water temperatures with temperature setpoints, for example, A, B, C, and D. In this example, the setpoint temperatures ascend as the alphabetical order ascends. Compressor 310A is actuated when sensor 410 senses the water temperature decreasing to setpoint B, and is stopped when sensor 410 senses the water temperature increasing to setpoint D. If needed to meet system demand, Compressor 310B is actuated when sensor 410 senses the water temperature decreasing to setpoint A, and is stopped upon sensor 410 senses the water temperature increasing to setpoint C. For variable speed compressors, the compressor speed is modulated between the setpoints. The lead and lag compressors may be periodically or cyclically alternated to equalize compressor runtimes.

The closed loop condenser water system circulates water through the condenser 320 of the water-to-water heat pump 140, in which heat has been absorbed into the utility water. The heated utility water then flows into the condenser water buffer 100. The condenser water is circulated through double-walled heat exchanger 120 using circulator 130. Domestic potable water flows through the opposite side of the heat exchanger 120, with the domestic hot water system of a building being an example of a third water loop, although it is an open loop in most cases. Heat is exchanged from the circulating condenser water and instantaneously heats the domestic water as it leaves to support the building domestic hot water system.

Domestic hot water loads within a multi-family residential or commercial building vary throughout the day. To meet varying demand, a temperature control loop may control the flow of condenser water through the double-walled heat exchanger 120 by changing the position of valve 170. Valve 170 is a three-way diverting valve with water entering one port and flowing out through two ports proportionate to the flow required to control the temperature of the leaving domestic water as measured by sensor 160. An electronic temperature controller 150 changes the position of the valve by an electronic signal to the valve actuator.

Source water from the building flows through the evaporator 340 and is cooled as it leaves the water-to-water heat pump 140 and returns to the building in the embodiment as shown, which may be downstream of the source outlet. Typically, source water originates from the building cooling water system. Expected water-to-water heat pump Coefficient of Performance (COP) is greater than 3.5. Consequently, this invention allows for simultaneous production of cooled water and heated domestic water heating, which may provide a typical Simultaneous Coefficient of Performance (SCOP) greater than 6.0. The simultaneous cooling of building water may be utilized to supplement building cooling. Producing both hot water for use in baths, kitchens and the like while also producing water for building cooling represents efficient energy usage, and reduces facility energy consumption.

Water exiting the heat pump in the closed loop is not uniform in temperature. In the present invention, fluctuations in utility water temperature may be dampened internally in the condenser water buffer 100 and controller 420. Further, the temperature of the domestic hot water is controlled with a modulating control valve 170 and temperature controller 150 on the flow of utility water to double-walled heat exchanger 120. Domestic hot water supply temperature sensor 160 measures the outlet water temperature and temperature controller 150, through a proportional/integral/derivative control loop, modulates control valve 170 based on instantaneous requirements. The system preferably provides water from the closed loop to heat exchanger 120 having a temperature that is plus or minus 0.5° F.

Buffer 100 acts as a hydraulic and thermal buffer that allows variations in water temperature from heated utility water received from the heat pump 140 to equalize. Buffer 100 is positioned in the closed loop of the utility water system between the heat pump and the heat exchanger 120. In a preferred embodiment, the volume of utility water closed loop, including buffer 100, is no more than 25% of storage tank volume used in a domestic hot water system of conventional heat pump water heaters, in which a heat pump directly heats the domestic hot water, since the buffer is for control of water temperature and not for water storage. The buffer could be defined by piping, such as oversized piping, positioned between the heat pump condenser and the heat exchanger 120. In the present invention, buffer 100 is not required for heat pumps with variable speed compressors.

An expansion tank 110 communicates with the buffer 100 to accommodate thermal expansion of the utility water. A diaphragm or bladder in the expansion tank keeps the pressure in the expansion tank substantially constant.

While the utility water system is defined as a closed loop, provision may be made to add water to the utility water system due to evaporation or other water loss due to operation or otherwise. The operational pressure of the system should be maintained, and water volume in the system is a factor in maintaining operational pressure.

In addition, when the domestic water system pressure is elevated due to the height of the building, the double-walled heat exchanger 120 in this system isolates the lower operating pressure heat pump components from the elevated pressure in the domestic water system. The double walled heat exchanger aids in preventing system leaks. If the interior wall develops a leak, the water enters an area between the walls of the heat exchanger. A weep hole in the second wall allows limited flow from the weep hole, but signals that a leak is present in the heat exchanger, avoiding a catastrophic failure. In a conventional heat pump water heater, the hot water storage tank must be designed for the elevated pressure as well as the condenser water components of the heat pump.

In certain situations, the source water temperature is above the range of operation for the heat pump to function properly. Subassembly 200 cooling loop may be provided to alleviate this problem. An additional circulating pump 210 may be added to the source water piping that provides water to the heat pump evaporator 340. This enables source water to circulate the evaporator heat exchanger independently of the flow of external source water. Temperature controller 240 adjusts the position of control valve 220 to allow source water to return to the cooling water system, thus causing additional flow of source water into the evaporator. The temperature of the water at temperature sensor 230 increases as additional source water from the source is introduced to the evaporator 340, and decreases as less water is returned to the cooling or source water system.

This invention negates the need for domestic hot water storage and provides instantaneous domestic hot water as needed. Domestic hot water storage may be utilized, but is not required. The device can be constructed as a stand-alone appliance that can be inserted into the building water system between the cooling water source (the first loop) and the domestic hot water system (the third loop). In the event that the appliance fails, it can be removed for repair or replacement with another appliance inserted into the system between the cooling water source and the domestic hot water system.

What is claimed:

1. An instantaneous hot water appliance, comprising: a heat pump, the heat pump constructed for connection to source water; a heat exchanger, the heat exchanger constructed for connection to a domestic hot water system of a facility; and a water pump, wherein the heat pump extracts heat from the source water and cools the source water, and wherein the heat pump and the heat exchanger are connected within a closed loop utility water system, and utility water in the closed loop system is heated by the heat pump and circulated by the water pump to the heat exchanger, wherein heat is exchanged within the heat exchanger from the utility water in the closed loop system, and the water pump circulates the utility water within the closed loop water system from the heat exchanger to the heat pump, where the utility water is again heated, and further comprising a condenser outlet temperature sensor that is constructed to communicate with utility water exiting the condenser, and a controller, wherein the controller actuates a first compressor of the heat pump when the utility water exiting the condenser decreases to the first temperature and terminates actuation of the first compressor of the heat pump when the utility water exiting the condenser reaches a second temperature that is higher than the first temperature, and the controller actuates a second compressor of the heat pump when the utility water exiting the condenser decreases to the third temperature and terminates actuation of the second compressor of the heat pump when the utility water exiting the condenser reaches a fourth temperature.

2. An instantaneous hot water appliance as described in claim 1, further comprising a buffer positioned with the closed loop utility water system between the heat pump and the heat exchanger, wherein the buffer is constructed and arranged to control the temperature of the utility water received from the heat pump to create a substantially consistent water temperature exiting the buffer.

3. An instantaneous hot water appliance as described in claim 1, wherein the third temperature is lower than the first temperature.

4. An instantaneous hot water appliance as described in claim 1, wherein the fourth temperature is lower than the second temperature.

5. An instantaneous hot water appliance as described in claim 1, wherein, in a subsequent operational cycle, the controller actuates a first compressor of the heat pump when the utility water exiting the condenser reaches the third temperature and terminates actuation of the first compressor of the heat pump when the utility water exiting the condenser reaches the fourth temperature, and the controller actuates a second compressor of the heat pump when the utility water exiting the condenser reaches the first temperature and terminates actuation of the second compressor of the heat pump when the utility water exiting the condenser reaches the second temperature.

6. An instantaneous hot water appliance as described in claim 1, further comprising a buffer positioned with the closed loop utility water system between the heat pump and the heat exchanger, wherein the buffer is constructed and arranged to control the inconsistent temperature of the utility water received from the heat pump to a substantially consistent temperature for utility water exiting the buffer and directed to the heat exchanger, and further comprising an expansion tank that receives utility water from the buffer and controls the volume of water in the buffer resulting from thermal expansion of utility water in the buffer.

7. An instantaneous hot water appliance as described in claim 1, the closed loop water system further comprising a temperature control loop, wherein the temperature control loop receives utility water from the closed loop water system, and the temperature control loop comprises a control valve, a temperature sensor and a temperature controller, wherein the control valve opens to receive water from the closed loop water system upon receiving a signal from the temperature controller.

8. An instantaneous hot water appliance as described in claim 1, the heat pump further comprising a heat exchanger, and the instantaneous hot water appliance as described in claim 1 further comprising a cooling loop that is constructed to receive water from the cooling water source, the cooling loop comprising a pump that communicates with the heat exchanger of the heat pump, a temperature sensor, a temperature controller, and a control valve, wherein the temperature controller positions the control valve to cause source water to return to the cooling water source and increasing the flow of source water into the heat exchanger.

9. An instantaneous hot water appliance as described in claim 1, wherein the source water that is cooled is provided to a facility for cooling.

10. An instantaneous hot water appliance as described in claim 1, wherein heat is extracted from the source water by an evaporator.

11. An instantaneous hot water appliance as described in claim 1, wherein the instantaneous hot water appliance operates at a Simultaneous Coefficient of Performance (SCOP) greater than 6.0.

12. An instantaneous hot water appliance as described in claim 1, wherein heat is exchanged within the heat exchanger from the utility water in the closed loop system to heat a hot water supply for a facility.

13. An instantaneous hot water appliance as described in claim 1, further comprising a buffer, wherein the buffer receives heated water from the heat pump, and wherein the heated water received from the heat pump by the buffer has an inconsistent temperature, and further comprising valve that receives heated water exiting the buffer, and further comprising a temperature controller that controls the valve, and wherein the valve directs heated water to the heat exchanger or to the heat pump according to the temperature of the water.

14. An instantaneous hot water appliance as described in claim 1, wherein the heat exchanger is a double-walled heat exchanger constructed and arranged to isolate lower operating pressure in the heat pump and the heat exchanger closed loop utility water system from higher pressure in the domestic water system.

15. An instantaneous hot water appliance as described in claim 1, further comprising a buffer, wherein the buffer is positioned to convey heated water received from the heat pump in a generally vertical direction, with heated water received from the heat pump received at a lower portion of the buffer and the heated water from the heat pump exiting the buffer at an upper portion of the buffer, with relatively hotter water received from the heat pump rising upwardly in the buffer and the heated water harvested from the upper portion of the buffer.

16. An instantaneous hot water appliance as described in claim 1, further comprising a source water cooling loop, the source water cooling loop constructed and arranged to divert cooled source water exiting the heat pump to the incoming water supply that is directed to the heat pump.

* * * * *